US006622877B2

(12) United States Patent
Plass

(10) Patent No.: US 6,622,877 B2
(45) Date of Patent: Sep. 23, 2003

(54) OVERHEAD CRANE WITH ADJUSTABLE BEARING ASSEMBLIES

(75) Inventor: Thomas E. Plass, Muskego, WI (US)

(73) Assignee: MHE Technologies, Inc., Wilmington, DE (US)

( * ) Notice: Subject to any disclaimer, the term of this patent is extended or adjusted under 35 U.S.C. 154(b) by 48 days.

(21) Appl. No.: 09/873,861

(22) Filed: Jun. 4, 2001

(65) Prior Publication Data

US 2002/0179560 A1 Dec. 5, 2002

(51) Int. Cl.[7] ..... B61B 1/00
(52) U.S. Cl. ..... 212/312; 105/163.1; 384/255
(58) Field of Search ..... 212/312; 105/163.1; 384/255

(56) References Cited

U.S. PATENT DOCUMENTS

| | | | |
|---|---|---|---|
| 1,375,536 A | | 4/1921 | Ostrander |
| 1,583,785 A | | 5/1926 | Evans |
| 2,581,298 A | | 1/1952 | De Forest Roe |
| 2,860,015 A | * | 11/1958 | Matterson |
| 3,257,968 A | * | 6/1966 | Minty et al. |
| 3,334,911 A | | 8/1967 | Enters |
| 3,342,507 A | | 9/1967 | Koch et al. |
| 3,547,284 A | | 12/1970 | Dunbar |
| 3,670,357 A | | 6/1972 | Steigerwald |
| 4,603,868 A | | 8/1986 | Schutz |
| 4,653,968 A | | 3/1987 | Rapata et al. |
| 4,773,691 A | | 9/1988 | Bernd et al. |
| 5,056,671 A | | 10/1991 | Thorsen |
| 5,366,232 A | | 11/1994 | Pozzobon et al. |
| 5,779,260 A | | 7/1998 | Reilly et al. |
| 5,791,257 A | | 8/1998 | Konop |

FOREIGN PATENT DOCUMENTS

| | | | |
|---|---|---|---|
| DD | 203 892 | | 12/1981 |
| DE | 7712358 | | 8/1977 |
| EP | 0626336 A1 | | 5/1994 |
| GB | 1191868 | | 8/1968 |
| GB | 2245664 A | | 6/1991 |
| JP | 11-124206 | * | 5/1999 |

* cited by examiner

*Primary Examiner*—Thomas J. Brahan
(74) *Attorney, Agent, or Firm*—Michael Best & Friedrich

(57) ABSTRACT

An overhead crane having an adjustable bearing assembly to adjust a wheel and axle of the crane in a horizontal direction in order to minimize skewing of the crane on a pair of parallel rails. A bearing retainer includes an outer surface sized to fit into an associated bore in an end truck of the crane, and an eccentric inner surface which engages the outer surface of a bearing. When the bearing retainer is rotated, the wheel and axle extending therethrough are moved in a horizontal direction. The bearing retainer includes a closed end having a surface which is engageable by a tool to allow for the rotation of the bearing retainer. A locking ring releasably fixes the bearing retainer and therefore the bearing to the frame of the crane as desired.

20 Claims, 2 Drawing Sheets

OVERHEAD CRANE WITH ADJUSTABLE BEARING ASSEMBLIES

FIELD OF THE INVENTION

The present invention relates generally to overhead cranes which travel on wheels along spaced apart, generally parallel rails. More particularly, the present invention relates to the bearing assemblies for supporting the wheels for rotation relative to the frame.

BACKGROUND OF THE INVENTION

Overhead cranes are subject to the continuous problem of skewing on the rails. Misaligned wheels on a crane bridge can cause serious tracking problems that can result in progressive damage to the crane, the building runway and other structural components.

U.S. Pat. No. 5,791,257 to Jeffrey A. Konop provides a bearing assembly that allows adjustment of the alignment of overhead crane wheels. The frame of the overhead crane has a cylindrical opening and a sleeve is housed in the frame opening. The sleeve has therein an eccentric opening housing a bearing. By rotating the eccentric sleeve, the center of the bearing and thus the wheel moves with respect to the frame, thereby allowing for alignment of the wheels. A spanner wrench is used to rotate the sleeve relative to the frame, and set screws are used to releasably secure the sleeve relative to the bearing. Although U.S. Pat. No. 5,791,257 provides a relatively simple system to realign a set of overhead crane wheels, there still exists a need for other, alternative systems for realigning a set of overhead crane wheels.

SUMMARY OF THE INVENTION

The invention provides a bearing assembly including a bearing for supporting a wheel for rotation about an axis, and a bearing retainer housed in an opening of the frame of an overhead crane. According to one embodiment of the invention, the inner surface of the bearing retainer directly engages the outer surface of the outer race of the bearing, and the inner surface of the bearing retainer is eccentric relative to the outer surface of the bearing retainer. In this manner, rotation of the bearing retainer relative to the frame moves the bearing and thereby the center of the wheel relative to the frame so that the position of the center of the wheel is adjustable relative to the frame in an infinite number of positions. In effect, the rotation of the bearing retainer moves the axle supporting the wheel in a horizontal direction in order to align a crane wheel for proper tracking. The bearing retainer is also fixable relative to the frame so as to position the axle of the wheel relative to the frame in the desired location.

Although the device disclosed in U.S. Pat. No. 5,791,257 works well for its intended purpose, the present invention is an improvement over such device. The bearing retainer of the present invention is easier to manipulate than the sleeve of the prior patent because the present invention does not require the use of the spanner wrench as such is disclosed in the prior patent. Moreover, the present invention utilizes fewer parts than the device of the prior patent, thereby providing a more economical and user friendly design.

In another embodiment of the invention, the bearing retainer includes a closed end that has an outer face having a surface which is engageable with a tool for rotating the bearing retainer and thus the axle relative to the frame. In a preferred embodiment of the invention, a hex head is fixed to the outer face of the bearing retainer to provide a simple, yet effective means for rotating the bearing retainer.

In another embodiment of the invention, a locking ring secures the bearing retainer to the frame of the crane. The locking ring is releasably fixed to the frame, such that fixing the locking ring to the frame causes the locking ring to clamp a surface of the bearing retainer against the frame so that once the center of the wheel is properly aligned, the bearing retainer and thus the axle are fixed relative to the frame.

The present invention provides a simple and economical solution to the problem of the skewing of a crane on the rails.

The present invention provides a new way of changing the rotational axis of a wheel of a crane relative to the frame of the crane in order to align the wheel for proper tracking, and a new way of fixing the rotational axis of the wheel relative to the frame when the proper alignment is obtained.

Other features and advantages of the invention will become apparent to those skilled in the art upon review of the following detailed description, claims and drawings in which like numerals are used to designate like features.

Figure 1:
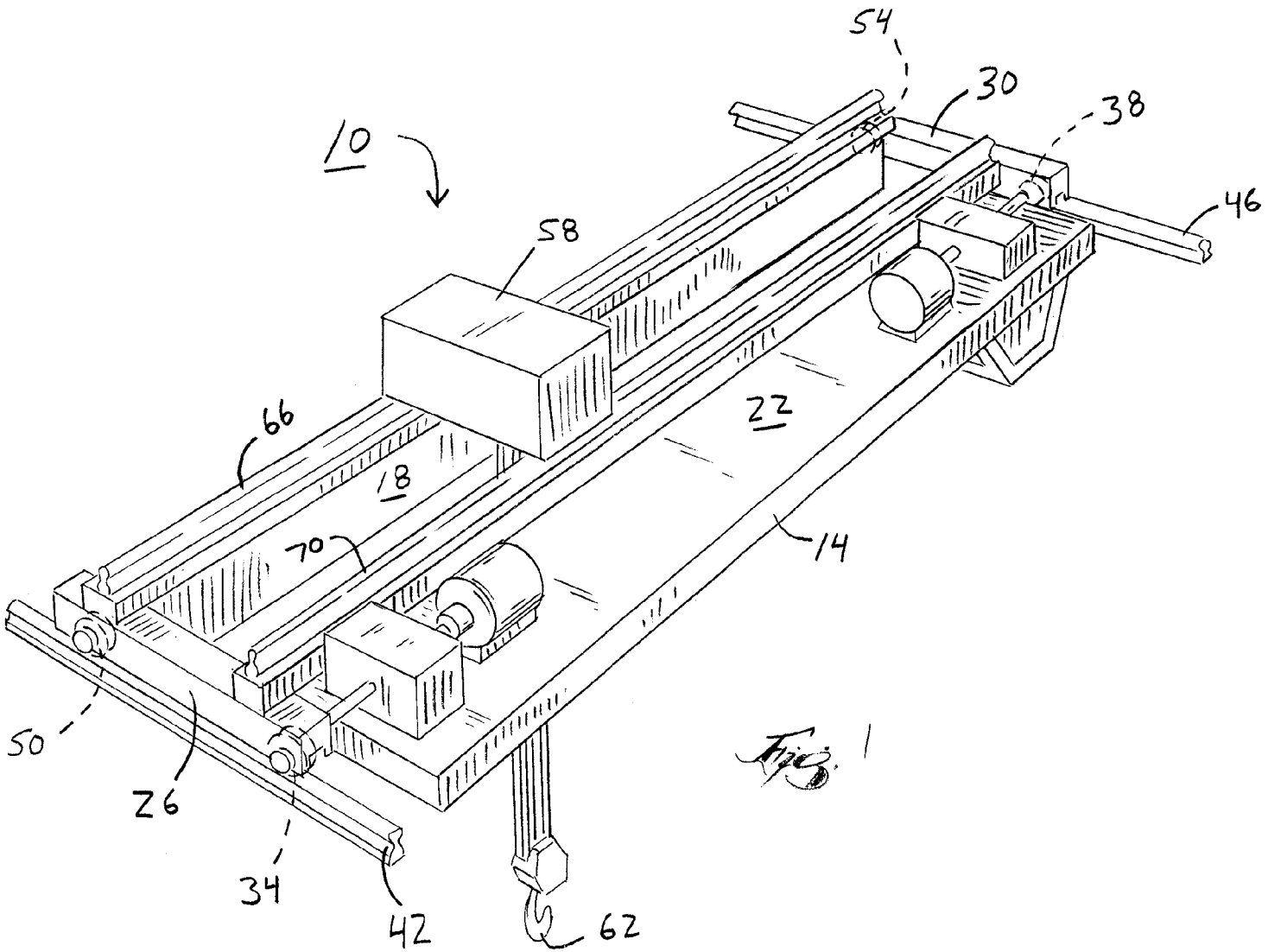
FIG. 1 is a perspective view of an overhead crane embodying the invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof.

DETAILED DESCRIPTION OF THE PREFERRED EMBODIMENT

An overhead crane 10 embodying the invention is shown in FIG. 1. It should be understood that the present invention is capable of use in other overhead cranes and the overhead crane 10 is merely shown and described as an example of one such crane.

The crane 10 comprises a frame 14 including a pair of bridge cross-members 18 and 22, and trucks 26 and 30 at opposite ends of the cross-members 18 and 22. Drive wheels 34 and 38 are respectively rotatably mounted on the trucks 26 and 30 in engagement with rails 42 and 46, respectively, so that the rails support the crane 10. Additional non-driven or idler wheels 50 and 54 are respectively rotatably mounted on the trucks 26 and 30 in engagement with the rails 42 and 46, respectively, for further support of the crane 10. The manner in which the wheels 34, 38, 50 and 54 are mounted to the trucks 26 and 30 is described below. A hoist 58 having a vertically movable load hook 62 is supported for travel on tracks 66 and 70 which are respectively mounted on the cross-members 18 and 22 of the crane 10. The crane 10 has not been described in great detail because the crane 10 thus far described is conventional. Reference is made to U.S. Pat.

No. 5,791,257, which is incorporated herein by reference, for further description as needed.

Figure 2:
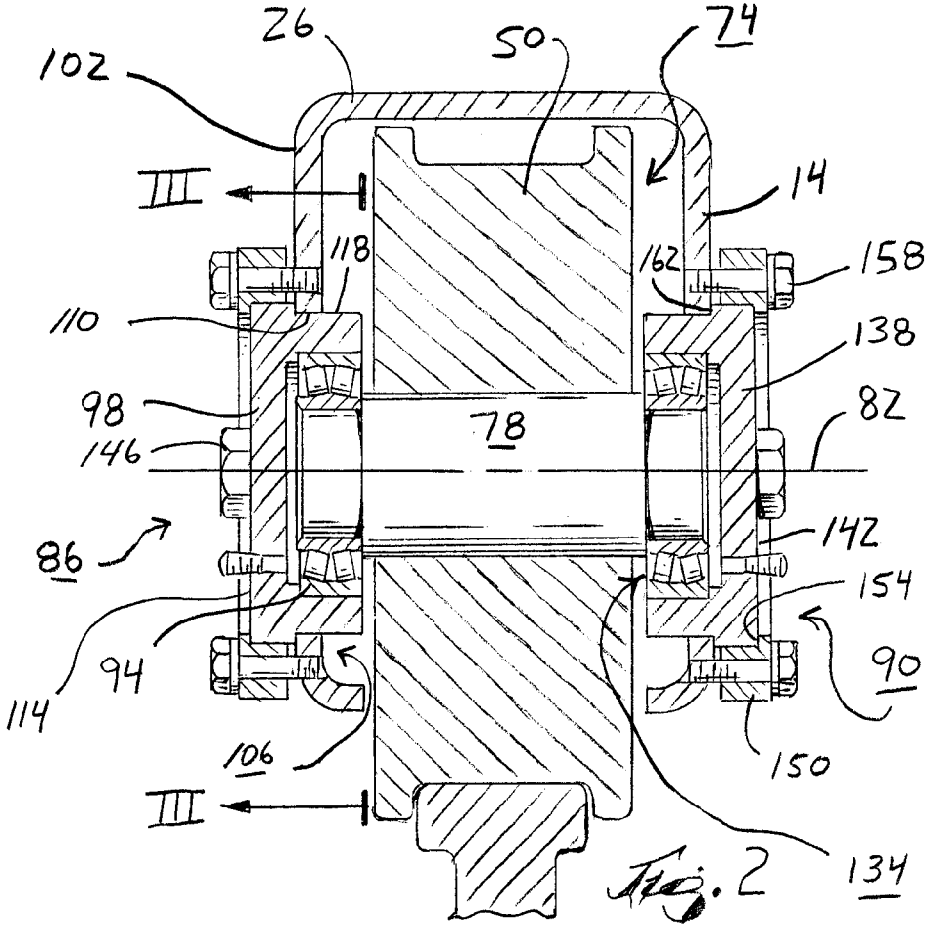
FIG. 2 is a vertical sectional view of a wheel assembly.

A wheel assembly 74 including the idler wheel 50 is illustrated in FIG. 2. The wheel is mounted on an axle 78 having a central or rotational axis 82. The axle 78 is supported relative to the frame 14, and specifically the end truck 26, by two bearing assemblies 86 and 90. The bearing assemblies 86 and 90 are mirror images of each other, and description of one can be viewed as description of the other.

Figure 3:
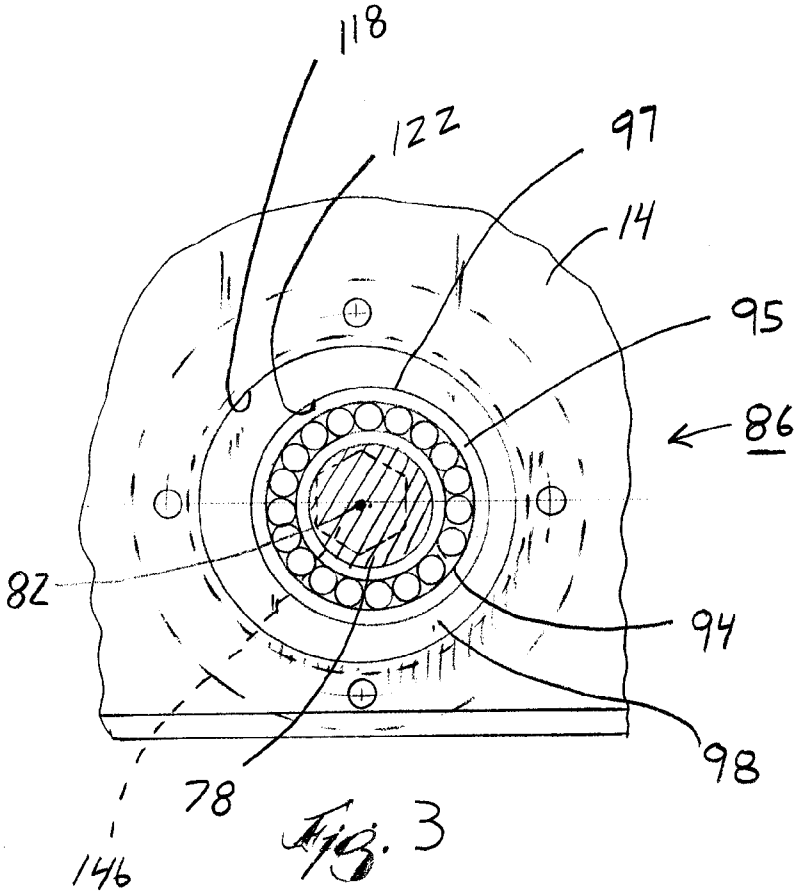
FIG. 3 is a view taken along line III—III in FIG. 2.

With reference to FIGS. 2 and 3, the bearing assembly 86 includes a bearing 94 supporting the wheel 50 for rotation about the axis 82. The bearing 94 includes an outer race 95 having an outer surface 97. The bearing assembly 86 also includes a bearing retainer 98 housing the bearing 94 and for allowing the rotational axis 82 to be adjusted relative to the frame 14 in an infinite number of positions. As shown, the frame 14 includes an outer surface 102 having therein a cylindrical opening 106 defined by a cylindrical frame inner surface 110. The bearing retainer 98 includes an outer surface 114 having a cylindrical outer surface portion 118 that is received by the frame opening 106 and that engages the frame inner surface 110. The bearing retainer 98 further includes an inner surface 122 that directly engages the outer surface 97 of the outer race 95 of the bearing 94. The inner surface 122 is eccentric relative to the outer surface portion 118, such that rotation of the bearing retainer 98 within the opening 106 relative to the frame 14 moves the bearing 94 and thereby the rotational axis 82 of the wheel 50 relative to the frame 14 so that the position of the rotational axis 82 of the wheel 50 is adjustable relative to the frame 14 in an infinite number of positions. It should be understood that the bearing retainer 98 can be rotated 360° or less.

The bearing retainer 98 has an open end 134 and a closed end 138 which are spaced apart in the direction of the axis 82. The closed end 138 has an outer face 142 having fixed thereon a hex head 146. The hex head 146 is concentric with the outer surface 118 of the bearing retainer 98, and the inner surface 110 of the frame opening 106. The hex head 146 is engageable with an appropriate hand tool to rotate the bearing retainer 98 relative to the frame 14.

A locking ring 150 overlaps a peripheral portion 154 of the outer face 142. The locking ring 150 is releasably fixed to the frame 14 by a plurality of threaded fasteners 158 which extend through the locking ring 150 and into the frame 14. Threading the fasteners 158 into the frame 14 causes the locking ring 150 to clamp an annular shoulder 162 of the outer surface 114 of the bearing retainer 98 against the frame outer surface 102, thereby fixing the bearing retainer 98 and thus the bearing 94 to the frame 14 so as to fix the location of the rotational axis 82 relative to the frame 14.

A single adjustable bearing assembly 86 could be used on one end 26 of the frame 14, or multiple adjustable bearing assemblies 86 and 90 could be used on both ends 26 and 30 of the frame 14, depending on the amount of angular adjustment desired. Moreover, each wheel assembly for the wheels 34, 38, 50 and 54 could use a single adjustable bearing assembly 86 or a pair of adjustable bearing assemblies 86 and 90.

The adjustable bearing assemblies 86 and 90 of the present invention can be used in new cranes or retrofitted for existing cranes. To align a wheel, such as wheel 50, of a crane, such as crane 10, the locking ring 50 is loosely attached to the frame 14 with the threaded fasteners 158 so that the bearing retainer 98 and, therefore, the bearing 94, cannot fall out of the opening 106 of the frame 14. A wrench or other suitable tool is used to engage the hex head 146 to rotate the bearing retainer 98 relative to the frame 14. The bearing retainer 98 is rotated until the center of the wheel 50 is properly aligned. Thereafter, the locking ring 150 is securely fixed to the frame 14 with the threaded fasteners 158 to prevent any further rotation of the bearing retainer 98.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. An overhead crane adapted to be supported on a pair of spaced apart, generally parallel rails, said crane comprising:

a frame which includes a frame outer surface having therein a generally cylindrical frame opening;

a wheel adapted to roll alone one of the rails;

a bearing assembly supporting the wheel for rotation relative to the frame, the bearing assembly including a bearing supporting the wheel for rotation about an axis having a position relative to the frame, the bearing having an outer race with a generally cylindrical outer surface; and a generally cylindrical bearing retainer housed in the frame opening, the bearing retainer having an outer surface including an engagement surface facing the frame outer surface and a generally cylindrical outer surface portion that is received by the frame opening, the bearing retainer further having a generally cylindrical inner surface housing the bearing and directly engaging outer surface of the outer race of the bearing, wherein the inner surface of the bearing retainer is eccentric relative to the outer surface portion of the bearing retainer, such that rotation of the bearing retainer relative to the frame moves the bearing and thereby the rotational axis of the wheel relative to the frame so that the position of the rotational axis of the wheel is adjustable relative to the frame in an infinite number of positions, and such that the bearing retainer is fixable relative to the frame so as to fix the rotational axis of the wheel relative to the frame;

a locking ring that engages the bearing retainer, the locking ring being releasably fixed to the frame, such that fixing the locking ring to the frame causes the locking ring to clamp the engagement surface of the bearing retainer against the frame outer surface, thereby substantially preventing rotation of the bearing retainer relative to the frame;

a hoist supported by the frame; and a load engaging mechanism which is raised and lowered by the hoist.

2. An overhead crane as set forth in claim 1, wherein the frame opening is defined by a generally cylindrical frame inner surface, and the generally cylindrical outer surface portion of the outer surface of the bearing retainer directly engages the frame inner surface.

3. An overhead crane as set forth in claim 1, wherein the bearing retainer includes a closed end that includes an outer face having a surface which is engageable with a tool for rotating the bearing retainer in the frame opening and relative to the frame.

4. An overhead crane as set forth in claim 3, wherein the engagement surface of the outer face is a hex head that is permanently fixed thereto.

5. An overhead crane as set forth in claim 1, wherein the engagement surface of the outer surface of the bearing retainer is an annular shoulder.

6. An overhead crane as set forth in claim 1, wherein the locking ring overlaps a peripheral portion of an outer face of the outer surface of the bearing retainer.

7. An overhead crane as set forth in claim 1, wherein the locking ring is releasably fixed to the frame by a plurality of threaded fasteners which extend through the locking ring and into the frame.

8. An overhead crane as set forth in claim 1, wherein the locking ring is disposed axially outboard of the frame outer surface.

9. An overhead crane adapted to be supported on a pair of spaced apart, generally parallel rails, said crane comprising:

a frame which includes a generally cylindrical frame opening;

a wheel adapted to roll along one of the rails;

a bearing assembly supporting the wheel for rotation relative to the frame, the bearing assembly including a bearing supporting the wheel for rotation about an axis having a position relative to the frame; and a generally cylindrical bearing retainer which is housed in the frame opening and which houses the bearing, the bearing retainer having a generally cylindrical outer surface portion that is directly engaged by the frame opening, the bearing retainer also having a closed end that includes an outer face having a surface which is engageable with a tool for rotating the bearing retainer relative to the frame, such that rotation of the bearing retainer relative to the frame moves the bearing and thereby the rotational axis of the wheel relative to the frame so that the position of the rotational axis of the wheel is adjustable relative to the frame in an infinite number of positions, and such that the bearing retainer is fixable relative to the frame so as to fix the rotational axis of the wheel relative to the frame;

a locking ring that engages the bearing retainer, the locking ring being releasably fixed to the frame, such that fixing the locking ring to the frame causes the locking ring to clamp the bearing retainer against the frame, thereby substantially preventing rotation of the bearing retainer relative to the frame:

a hoist supported by the frame; and a load engaging mechanism which is raised and lowered by the hoist.

10. An overhead crane as set forth in claim 9, wherein the engagement surface of the outer face is a hex head that is permanently fixed thereto.

11. An overhead crane as set forth in claim 9, wherein the frame includes a frame outer surface having therein the frame opening, the outer surface of the bearing retainer also includes an engagement surface facing the frame outer surface, and the engagement surface of the bearing retainer is clamped against the frame outer surface when the locking ring is fixed, to the frame.

12. An overhead crane as set forth in claim 11, wherein the engagement surface of the outer surface of the bearing retainer is an annular shoulder.

13. An overhead crane as set forth in claim 11, wherein the locking ring overlaps a peripheral portion of an outer face of the outer surface of the bearing retainer.

14. An overhead crane as set forth in claim 11, wherein the locking ring is releasably fixed to the frame by a plurality of threaded fasteners which extend through the locking ring and into the frame.

15. An overhead crane as set forth in claim 9, wherein the engagement surface of the outer face is a hex head that is fixed thereto, and wherein the generally cylindrical outer surface portion is concentric with the hex head.

16. An overhead crane adapted to be supported on a pair of spaced apart, generally parallel rails, said crane comprising:

a frame which includes a frame outer surface having therein a generally cylindrical frame opening;

a wheel adapted to roll along one of the rails;

a bearing assembly supporting the wheel for rotation relative to the frame, the bearing assembly including a bearing supporting the wheel for rotation about an axis having a position relative to the frame;

a generally cylindrical bearing retainer which is housed in the frame opening and which houses the bearing, the bearing retainer having an outer surface including a generally cylindrical outer surface portion that is received by and that directly engages the frame opening, the outer surface of the bearing retainer also including an engagement surface facing the frame outer surface, the bearing retainer being rotatable relative to the frame such that rotation of the bearing retainer relative to the frame moves the bearing and thereby the rotational axis of the wheel relative to the frame so that the position of the rotational axis of the wheel is adjustable relative to the frame in an infinite number of positions; and a locking ring that engages the bearing retainer, the locking ring being releasably fixed to the frame, such that fixing the locking ring to the frame causes the locking ring to clamp the engagement surface of the bearing retainer against the frame outer surface, thereby substantially preventing rotation of the bearing retainer relative to the frame so as to fix the rotational axis of the wheel relative to the frame;

a hoist supported by the frame; and a load engaging mechanism which is raised and lowered by the hoist.

17. An overhead crane as set forth in claim 16, wherein the engagement surface of the outer surface of the bearing retainer is an annular shoulder.

18. An overhead crane as set forth in claim 16, wherein the locking ring overlaps a peripheral portion of an outer face of the outer surface of the bearing retainer.

19. An overhead crane as set forth in claim 15, wherein the locking ring is releasably fixed to the frame by a plurality of threaded fasteners which extend through the locking ring and into the frame.

20. An overhead crane adapted to be supported on a pair of spaced apart, generally parallel rails, said crane comprising:

a frame which includes a frame outer surface having therein a generally cylindrical frame opening defined by a generally cylindrical frame inner surface;

a wheel adapted to roll along one of the rails;

a bearing assembly supporting the wheel for rotation relative to the frame, the bearing assembly including a bearing supporting the wheel for rotation about an axis having a position relative to the frame, the bearing having an outer race with a generally cylindrical outer surface;

a generally cylindrical bearing retainer housed in the frame opening, the bearing retainer having an open end and a closed end, the ends being spaced in the direction of the axis, the closed end having an outer face having fixed thereon a hex head, the hex head being engageable with a tool to rotate the bearing retainer relative to the frame, and the bearing retainer further having an outer surface including a generally cylindrical outer surface portion that is concentric with the hex head, that is received by the frame opening, and that directly engages the frame inner surface, and the outer surface of the bearing retainer also including an annular shoulder facing the frame outer surface, and the bearing retainer further having a generally cylindrical inner surface housing the bearing and directly engaging the outer surface of the outer race of the bearing, wherein the inner surface of the bearing retainer is eccentric relative to the outer surface portion of the bearing retainer, such that rotation of the bearing retainer relative to the frame moves the bearing and thereby the rotational axis of the wheel relative to the frame so that the position of the rotational axis of the wheel is adjustable relative to the frame in an infinite number of positions; and a locking ring that overlaps a peripheral portion of the outer face of the closed end of the bearing retainer, the locking ring being releasably fixed to the frame by a plurality of threaded fasteners which extend through the locking ring and into the frame, such that threading the fasteners into the frame causes the locking ring to clamp the shoulder of the bearing retainer against the frame outer surface, thereby substantially preventing rotation of the bearing retainer relative to the frame so as to fix the rotational axis of the wheel relative to the frame;

a hoist supported by the frame; and a load engaging mechanism which is raised and lowered by the hoist.

* * * * *

UNITED STATES PATENT AND TRADEMARK OFFICE

CERTIFICATE OF CORRECTION

PATENT NO. : 6,622,877 B2
DATED : September 23, 2003
INVENTOR(S) : Thomas E. Plass It is certified that error appears in the above-identified patent and that said Letters Patent is hereby corrected as shown below:

Column 4,
Line 26, change the word “alone” to -- along --.
Line 40, after the word “engaging” add the word -- the --.

Column 5,
Line 64, delete “,” after the word “fixed”.

Signed and Sealed this

Sixteenth Day of March, 2004

JON W. DUDAS
*Acting Director of the United States Patent and Trademark Office*